US012723419B2

(12) United States Patent
Foote et al.

(10) Patent No.: US 12,723,419 B2
(45) Date of Patent: Sep. 1, 2026

(54) TOOL TO REMOVE PAD FROM UNDERNEATH INSTALLED OR PARTIALLY REMOVED CARPET

(71) Applicants: Darren Russell Foote, Reno, NV (US); Ryan Harold Foote, Centerton, AR (US); Gabe Arthur Foote, Reno, NV (US)

(72) Inventors: Darren Russell Foote, Reno, NV (US); Ryan Harold Foote, Centerton, AR (US); Gabe Arthur Foote, Reno, NV (US)

( * ) Notice: Subject to any disclaimer, the term of this patent is extended or adjusted under 35 U.S.C. 154(b) by 54 days.

(21) Appl. No.: 18/824,759

(22) Filed: Sep. 4, 2024

(65) Prior Publication Data

US 2024/0426118 A1 Dec. 26, 2024

Related U.S. Application Data

(63) Continuation-in-part of application No. 17/403,463, filed on Aug. 16, 2021, now abandoned.

(60) Provisional application No. 63/066,224, filed on Aug. 15, 2020.

(51) Int. Cl.
*E04G 23/00* (2006.01)

(52) U.S. Cl.
CPC ..... *E04G 23/006* (2013.01)

(58) Field of Classification Search
CPC ..... E04G 23/006
USPC ..... 30/169
See application file for complete search history.

(56) References Cited

U.S. PATENT DOCUMENTS 4,291,430 A * 9/1981 Hightower ..... B03C 1/28 15/142
4,667,362 A * 5/1987 Mattingly ..... A47L 13/022 15/236.08
4,759,092 A * 7/1988 Duddy ..... B44D 3/162 15/236.08
4,809,386 A * 3/1989 Re ..... A47L 1/16 15/118
4,913,172 A * 4/1990 Chou ..... A01K 13/003 132/118
5,069,026 A * 12/1991 Johnson ..... A01D 7/10 56/400.17
5,079,905 A * 1/1992 Bergstrom ..... A01D 44/00 56/8
5,605,034 A * 2/1997 South ..... A63B 57/00 56/400.21
5,915,794 A * 6/1999 Neff ..... A47L 13/022 30/169
7,013,524 B1 * 3/2006 Mollree, Sr. ..... A47J 37/0786 15/236.08
8,522,649 B2 * 9/2013 Yousufzai ..... E04D 15/003 30/169
2004/0145197 A1 * 7/2004 Kubicka ..... E01H 5/02 294/54.5
2012/0261148 A1 * 10/2012 Sukhovitsky ..... A01B 1/16 172/378

(Continued)

*Primary Examiner* — Sean M Michalski
(74) *Attorney, Agent, or Firm* — LOZA & LOZA, LLP; Tyler J. Barrett

(57) ABSTRACT

Carpet pad removal tools may include a handle and a headplate coupled to the handle. The headplate may include a plurality of teeth along an edge of the headplate that is angled relative to the rest of the headplate. Other aspects, embodiments, and features are also included.

5 Claims, 1 Drawing Sheet

(56) References Cited

U.S. PATENT DOCUMENTS

2014/0299824 A1* 10/2014 Knox ..... B25C 11/00
254/28

* cited by examiner

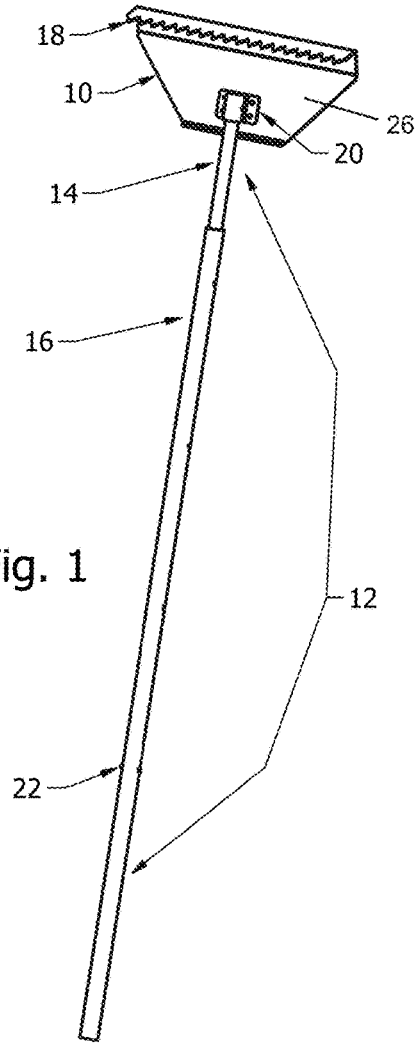
Fig. 1
Fig. 2
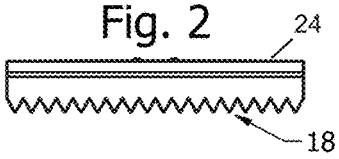
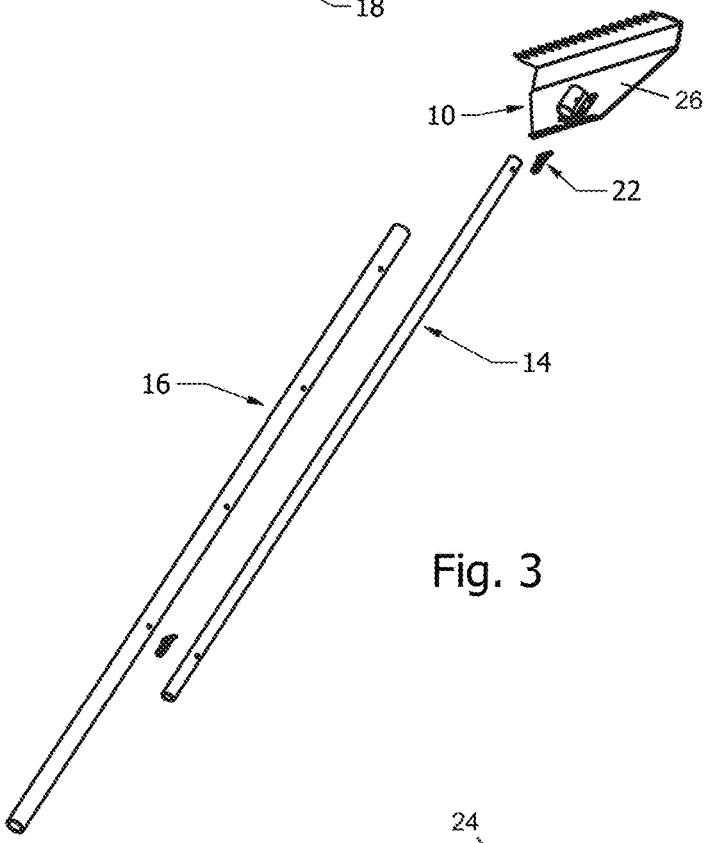
Fig. 3
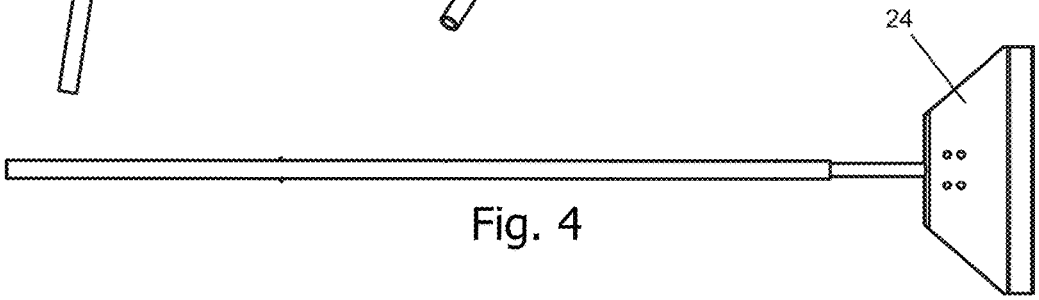
Fig. 4
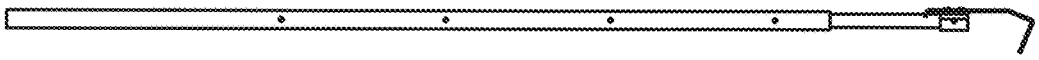
Fig. 5
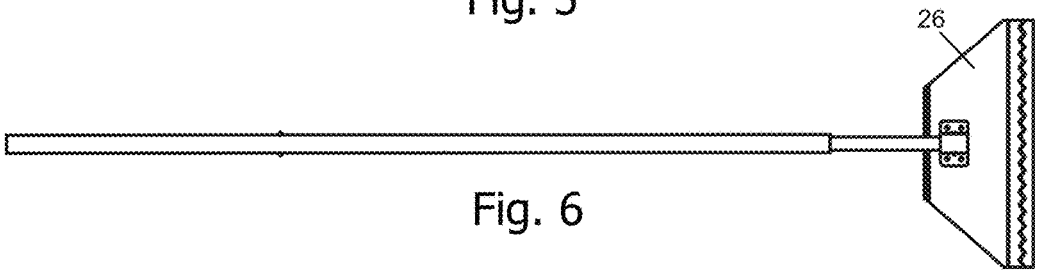
Fig. 6

TOOL TO REMOVE PAD FROM UNDERNEATH INSTALLED OR PARTIALLY REMOVED CARPET

CROSS REFERENCE TO RELATED APPLICATIONS

This application is a continuation-in-part application of and claims priority to U.S. patent application Ser. No. 17/403,463 filed Aug. 16, 2021, which application claims priority to U.S. Provisional Patent Application No. 63/066,224 filed Aug. 15, 2020, the entire contents of which are incorporated by reference herein for all purposes.

TECHNICAL FIELD

This disclosure relates to the field of the removal of carpet padding from underneath installed or partially removed existing carpet.

BRIEF SUMMARY OF SOME EXAMPLES

The present disclosure provides a carpet pad removal tool and methods of making and using the carpet pad removal tool. According to at least one example, a carpet pad removal tool may include a handle, and a headplate coupled to the handle. The headplate may include a top side and an opposing bottom side coupled to the handle. The headplate may further include a plurality of teeth along an edge of the headplate, the edge of the headplate being angled relative to the rest of the headplate.

According to at least one example, a carpet pad removal tool may include a headplate and a handle. The headplate may include a top side, an opposing bottom side, and an edge with a plurality of teeth extending at least substantially downward from the bottom side of the headplate when the headplate is oriented with bottom side is positioned downward relative to ground. The handle may be coupled to the bottom side of the headplate without any part of the handle extending over the top side of the headplate.

Additional examples include methods of removing carpet pad. According to at least one example, such a method may include inserting a pad removal tool under a section of carpet and on top of a carpet pad located beneath the carpet, wherein the pad removal tool includes a handle, and a headplate coupled to the handle, the headplate including a plurality of teeth along an edge of the headplate, the edge of the headplate being angled relative to the rest of the headplate, wherein the headplate is coupled to the handle with the handle positioned on a bottom side of the headplate without any part of the handle extending over an opposing top side of the headplate. The plurality of teeth of the pad removal tool may be engaged into the carpet pad, the handle may be pulled to pull the headplate out from under the carpet, and a portion of the carpet pad may be removed from under the carpet.

The above features and advantages of the present disclosure will be better understood from the following detailed description taken in conjunction with the accompanying drawings.

BRIEF DESCRIPTION OF THE DRAWINGS

FIG. 1 is a perspective view of a tool to remove pad from underneath installed or partially removed carpet.

FIG. 2 illustrates an enlarged view of the teeth on the headplate of a tool to remove pad from underneath installed or partially removed carpet.

FIG. 3 illustrates an exploded (disassembled) bottom view of a tool to remove pad from underneath installed or partially removed carpet.

FIG. 4 illustrates a top view of a tool to remove pad from underneath installed or partially removed carpet.

FIG. 5 illustrates a side view of a tool to remove pad from underneath installed or partially removed carpet.

FIG. 6 illustrates a bottom view of a tool to remove pad from underneath installed or partially removed carpet.

DETAILED DESCRIPTION

The present disclosure will now be discussed in detail with regard to the attached drawing figures that were briefly described above. In the following description, numerous specific details are set forth illustrating the Applicant's best mode for practicing one or more embodiments, and enabling one of ordinary skill in the art to make and use the various disclosed embodiments. It will be obvious, however, to one skilled in the art that the present disclosure may be practiced without many of these specific details. In other instances, well-known machines, structures, and method steps have not been described in particular detail in order to avoid unnecessarily obscuring the present disclosure. Unless otherwise indicated, like parts and method steps are referred to with like reference numerals.

Carpet represents a significant investment for home and business owners and is expensive to replace if damaged due to being mishandled when removing the affected pad underneath. When carpet and pad, cushion, and/or underlay, referred to herein as pad or padding, are affected by water damage the goal is to save the carpet and to remove and replace the pad underneath. Removing affected pad is a best practice to allow for a quicker and proper drying process.

When carpet is wet it is the most susceptible to damage, which occurs during the process of removing the pad. This process involves lifting, manipulating and removing the carpet from the tack strip and/or cutting seams in the carpet to access and remove the wet padding. The disclosed embodiments include a developed tool to remove the pad from underneath installed or partially removed carpet, reducing the need to completely uninstall carpet as well as reducing the need to cut carpet seams.

The common method to remove pad is to first remove carpet from the tack strips, then fold, roll or bend the carpet as needed to remove the pad, put the carpet back in place and repeat until all or substantially all of the affected pad is removed. Cutting a seam in the carpet is a common practice when removing pad in tight areas, such as doorways, hallways, etc. Without cutting a seam it can be difficult or impossible to remove the affected pad. While this method works, it also presents Multiple issues.

Several non-limiting examples follow. Cutting carpet seams can result in permanent damage to the carpet or difficulty in re-seaming and reinstalling the carpet in an acceptable manner. Carpet is extremely delicate when wet and is easily damaged the more it is manipulated (e.g., lifting, rolling, bending, twisting, folding, stretching, wadding, etc.). When disengaging and removing wet carpet from the tack strip it is easy to delaminate the primary and secondary backing of the carpet causing irreversible structural damage. During the drying process, carpet often remains on site to be dried, with airflow directed underneath it. This airflow can cause the carpet that has been uninstalled or has a seam that has been cut to easily move or flap against the floor, wall or tack strips, causing damage to the carpet. Depending on the cleanliness of the water, carpet can often be salvaged, unless the carpet remains wet or is damaged due to removing the pad.

The tools described in relation to the disclosed embodiments provide several advantages over the existing and prior art. Specifically, these embodiments allow for all or substantially all affected pad to be removed without uninstalling a majority of the carpet from the tack strips. Leaving a large portion of the carpet installed allows for less manipulation which reduces the risk of delamination and damage to the carpet.

In tight or restrictive areas such as hallways, doorways, closets, etc., the disclosed embodiments have the advantage of being able to remove the pad without cutting seams. Without the tools used in these embodiments, the common methods would require carpet to be cut to allow access to the pad in these tight areas. The benefit of not cutting seams in the carpet, which minimizes the risk of damage, is it allows for proper and acceptable re-installation.

An additional advantage is that the disclosed embodiments minimize the time to remove pad by eliminating the need to uninstall a majority of the carpet in an area, as only a section will need to be uninstalled. The quicker the affected pad is removed, the sooner the drying process is able to begin.

The disclosed embodiments remove pad from underneath installed or partially removed carpet. Some embodiments may utilize a tool such as that shown in the non-limiting example embodiments in FIGS. 1-6. The non-limiting example in FIG. 1 is shown in perspective view. It is composed of a headplate 10 that may be attached to an extendable handle 12. The headplate 10 may include a top side (or surface) 24 and an opposing bottom side (or surface) 26.

An end of the handle 12 may be coupled to the headplate 10, with the handle 12 positioned on the bottom side 26 of the headplate 10. The end of the handle 12 may slide into a bracket 20, or any other handle attachment point, attached to the bottom side 26 of headplate 10 and may be fixed in place with spring push buttons 22, as seen in the non-limiting example embodiment in FIG. 3. As depicted, the handle 12 may be positioned so that no part of the handle 12 extends on or over the top side 24 of the headplate 10. In some embodiments, the handle 12 may be composed of tubes with different diameters made out of fiberglass or metal in some embodiments. In some embodiments, smaller diameter inner tube 14 may slide into the larger diameter outer tube 16 and in some embodiments may lock in place with a spring push button 22 allowing the handle length to be adjustable.

The headplate 10 may be made from aluminum plate or sheet metal that is wide enough to make each pass efficient while still allowing for maneuverability. In some embodiments, headplate 10 may have a plurality of teeth 18 along one edge, as seen in the non-limiting example embodiment in FIG. 2. In some embodiments, the edge of the headplate 10 with the teeth 18 may be angled relative to the rest of the headplate 10 to extend downward and away from the bottom side 26 of the headplate 10. That is, the headplate 10 includes a distal end thereof that is positioned such that the edge with the teeth 18 is located below the bottom side 26 when the bottom side 26 is facing downward relative to ground. In various embodiments, the edge of the headplate 10 with the teeth 18 may be rolled, bent or curved so that the teeth 18 are facing downwards away from the headplate 10 and back towards the handle 12 with an acute angle relative to the bottom side 26 that will allow for effectively removing the pad. In some embodiments, sides and edges may have been rolled down or smoothed as needed to prevent the tool from snagging the backside of the carpet.

The disclosed embodiments may be used on a water damage job with water intrusion affecting carpet and pad. A user may disengage and remove a section of carpet from the tack strip in the area where the affected pad needs to be removed. In some embodiments, the handle 12 may be adjusted to the desired length to reach the affected pad by sliding the smaller diameter tube 14 in or out of the larger diameter tube 16. The user may insert the tool, with the bottom side 26 and the teeth 18 facing down, under the carpet but on top of the pad, holding the handle 12 as close to the floor as possible. The user may then lift up on the handle 12 as much as is allowed without stretching the carpet and begin to retrieve the handle 12 from under the carpet, pulling and removing the pad with it. In some embodiments, the user may remove the pad in segmented sections, starting with the pad closest to the user and with each pass removing the pad farther into the room. The angle of the teeth 18 and the weight of the carpet may allow the teeth 18 to grab the pad and retrieve it from under the carpet with minimal removing, uninstalling or cutting of the carpet. Additionally, with the handle 12 positioned on the bottom side 26 of the headplate 10, the top side 24 of the headplate 10 can glide across the backside of the carpet without catching or snagging the backside of the carpet. In tighter and more restricted areas, where seams normally would need to be cut, the user may adjust the length of the handle 12, allowing room to insert the tool under the carpet. Removing pad using the disclosed embodiments allow for a larger portion of the carpet to stay installed and in one piece during the drying out process. This greatly reduces the risk of damaging carpet, allows for a quicker drying process due to removing excess water absorbed into the pad and saves time and effort previously required to remove pad.

It should be noted that the example embodiments described above are non-limiting, and several additional alternatives embodiments are also considered in this detailed disclosure. In some embodiments, different sizes, colors, shapes, interconnections, and materials (e.g., wood, fiberglass, other metals, and the like), may be used for all components. In some embodiments, a pin, bolt, twist/friction lock or other mechanism of any sort may be used in lieu of a push button, to attach the handle 12 to the headplate 10 or to connect the different sections of the handle 12 as well as allowing for extending or shortening the handle 12 to the desired length. In some embodiments, the handle 12 may be permanently fixed to the headplate 10. In some embodiments, the handle 12 may be adjusted using different methods and configurations. In some embodiments, the teeth 18 may have different configurations. As non-limiting examples, the teeth 18 may be sharper, duller, longer, shorter, may have different angles, may be shaped differently or spaced closer or farther apart, and the like. In some embodiments, the handle 12 can be longer or shorter. In some embodiments, the headplate 10 may have different shapes and sizes that will allow for the same result of removing pad under installed or partially removed carpet. In some embodiments, the handle 12 may have a grip, knurling or other finish on it. In some embodiments, the handle 12 may be made of fiberglass or like material, and the head portion, which may include a raking tool, may be made of plastic or other like material.

Other embodiments and uses of the above disclosures will be apparent to those having ordinary skill in the art upon consideration of the specification and practice of the embodiments disclosed herein. The specification and examples given should be considered exemplary only, and it is contemplated that the appended claims will cover any other such embodiments or modifications as fall within the true scope of the disclosure.

The invention claimed is:

1. A method of removing carpet pad, comprising:

inserting a pad removal tool under a section of carpet and on top of a carpet pad located beneath the carpet, wherein the pad removal tool includes a handle, and a headplate coupled to the handle, the headplate including a plurality of teeth along an edge of the headplate, the edge of the headplate being angled relative to the rest of the headplate, wherein the headplate is coupled to the handle with the handle positioned on a bottom side of the headplate without any part of the handle extending over an opposing top side of the headplate;

engaging the plurality of teeth of the pad removal tool into the carpet pad;

pulling the handle to pull the headplate out from under the carpet; and removing a portion of the carpet pad from under the carpet.

2. The method of claim 1, wherein the handle is extendable.

3. The method of claim 1, wherein the edge of the headplate is angled relative to the headplate so the teeth extend away from the headplate and toward the handle.

4. The method of claim 1, wherein the headplate further includes sides and edges that are rolled down or smoothed to prevent snagging on a backside of the carpet.

5. The method of claim 1, further comprising a bracket attached to the bottom side of the headplate, wherein a portion of the handle is coupled to the bracket on the bottom side of the headplate.

* * * * *